US007195109B2

(12) United States Patent
Mitchell et al.

(10) Patent No.: US 7,195,109 B2
(45) Date of Patent: Mar. 27, 2007

(54) EXPANSION SYSTEM FOR A LUGGAGE CASE

(75) Inventors: Ethan Mitchell, Riverside, RI (US); George Teixeira, Warren, RI (US); William L. King, Warren, RI (US)

(73) Assignee: Samsonite Corporation, Denver, CO (US)

( * ) Notice: Subject to any disclaimer, the term of this patent is extended or adjusted under 35 U.S.C. 154(b) by 0 days.

(21) Appl. No.: 11/059,125

(22) Filed: Feb. 16, 2005

(65) Prior Publication Data

US 2005/0194227 A1 Sep. 8, 2005

Related U.S. Application Data

(60) Provisional application No. 60/545,294, filed on Feb. 17, 2004.

(51) Int. Cl.
*A45C 7/00* (2006.01)
*A45C 5/14* (2006.01)

(52) U.S. Cl. ..... 190/103; 383/2

(58) Field of Classification Search ..... 190/36, 190/103–105, 119, 126; 383/2; 220/8
See application file for complete search history.

(56) References Cited

U.S. PATENT DOCUMENTS 856,042 A * 6/1907 Duplessis ..... 190/103
1,182,692 A * 5/1916 Lawler ..... 190/103
1,341,099 A * 5/1920 Abramson ..... 190/103
1,806,246 A * 5/1931 Feldman et al. ..... 190/103
2,670,776 A * 3/1954 Benner ..... 206/581
3,321,053 A * 5/1967 Doppelt ..... 190/104
4,366,886 A * 1/1983 Tawil ..... 190/103
4,630,717 A * 12/1986 Tong ..... 190/104
4,932,506 A * 6/1990 Kim ..... 190/111
5,080,206 A * 1/1992 Tawil ..... 190/103
5,358,082 A * 10/1994 Armstrong, IV ..... 190/21
6,325,189 B1 * 12/2001 King et al. ..... 190/119
2004/0262111 A1 * 12/2004 Ghiassi ..... 190/103

FOREIGN PATENT DOCUMENTS

GB 2173393 A * 10/1986

* cited by examiner

*Primary Examiner*—Sue A. Weaver
(74) *Attorney, Agent, or Firm*—Gregory W. O'Connor

(57) ABSTRACT

The present embodiment provides a neat, tailored accordion gusset 4 with crisscrossing elastic ribbons 22 attached to opposite rigid wire frames 8 and 10 of the expandable gusset 4, as well as a tensioned bungee cord 20 attached to the innermost edge of the center seam 26 of the expansion gusset 4. These elastic members 22 are enclosed and sealed from view by the outermost wall 6 of the luggage case 2 and an inner wall 14 defined by an elastic textile such as Spandex or the like. The resulting expansion gusset 4 can best be built into a main packing compartment door 6 of the luggage case 2 and will expand in response to over-packing of the main packing compartment 18 by expanding the expansion gusset 4 in response to the pressure of the goods against the restoring force of the various elastic members 22.

10 Claims, 4 Drawing Sheets

EXPANSION SYSTEM FOR A LUGGAGE CASE

BACKGROUND OF THE PRESENT EMBODIMENT

Luggage cases, especially those having a generally rigid box-like construction, do not expand when over-packed. At most, such cases tend to form a spherical shape, increasing slightly the packing volume available when the traveler insists on stuffing more things into that travel case than it was designed to carry. This is especially true when a traveler returns from vacation and the like and purchases more goods than were originally packed on the original departure. There have been many attempts to solve this problem. The most generally used solution involves a gusset with a zipper that holds the gusset together around the periphery of the case until a greater volume or expansion is needed. Then the zipper is unzipped around the periphery of the case, usually more than 360 degrees around the case, to reveal the gusset. The revealed gusset can then expand and accommodate more clothing and the like. Elastically controlled gussets have also been proposed. Other systems have been used. For example, an accordion section has been provided in the sides of the case with an elastic strap or telescoping struts to be used to either hold the gussets closed or stretch the gussets to their expanded position to create a greater packing volume.

The present embodiment relates to the former, where elastic members are used to control the unfolding or expansion of a peripheral accordion-like gusset in the rail of a case. More particularly, the present embodiment uses a series of different elastic members to control the expansion of and, more importantly, to bias the accordion gusset towards a closed position. It is a further object of the present embodiment to provide the case with a neat and tailored look when the case is either over-packed or when it is not.

DETAILED DESCRIPTION OF THE PREFERRED EMBODIMENT

Figure 1:
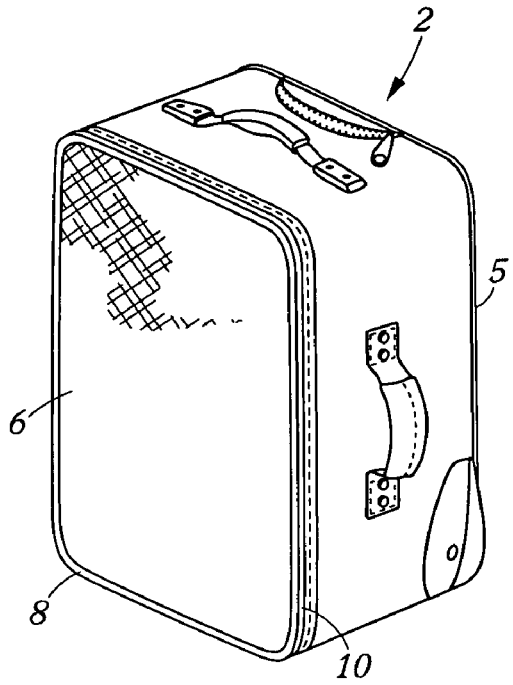
FIG. 1 shows a perspective view of a typical luggage case provided with the inventive expansion gusset, with that gusset in the contracted position.

The door construction 6 into which this expansion gusset 4 can be incorporated is shown in detail. Referring to a luggage case 2 shown in FIG. 1, the outer edges of the expansion gusset 4 are preferably made of two tempered steel wire frames. Outer steel wire frame 8 and inner steel wire frame 10 are surrounded by a conventional edge binding 12. The outer surface of expansion gusset 4 comprises a textile main door 6. This door 6 may be affixed to the body of the luggage case 2 by a textile self-hinge 7 and provide security to items stored within a main packing compartment 18. Door 6 may include exteriorally accessible pockets or the like and may also include a main surface of a molded ethylene vinyl acetate (EVA) textile and foam laminate to give sculptural definition thereto. The construction of these outer pockets does not form a part of the present embodiment.

Figure 6:
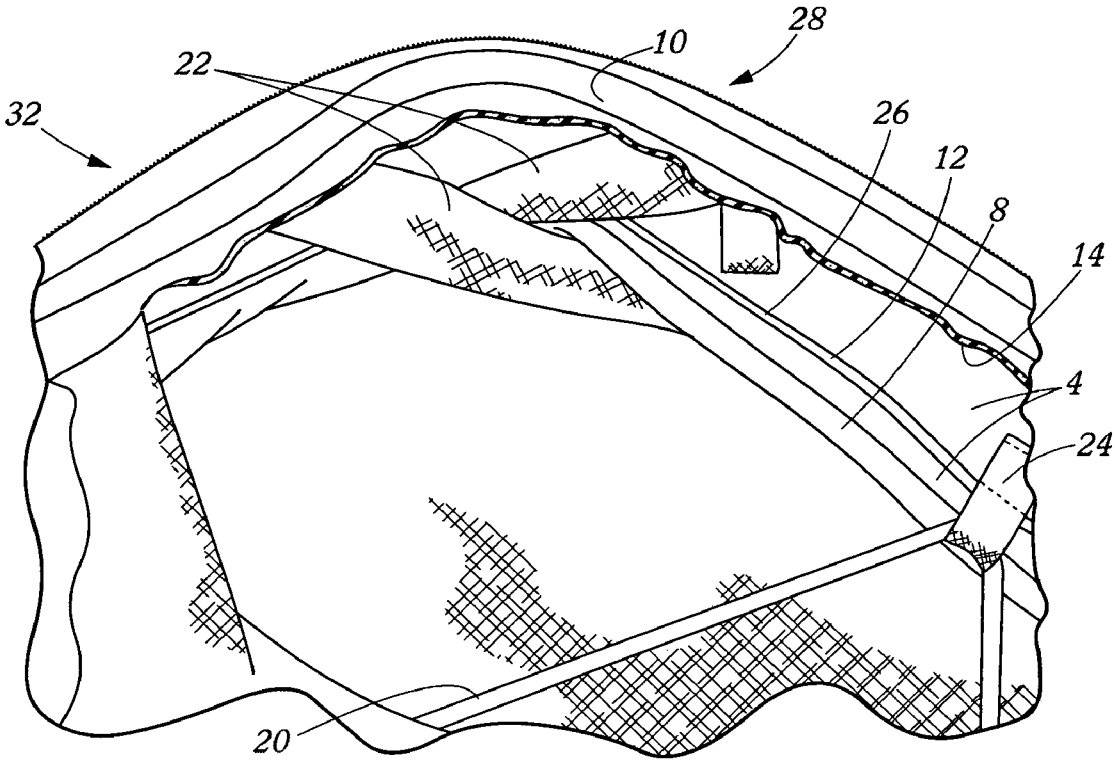
FIG. 6 is similar to FIG. 5, but with the gusset in an expanded position.
Figure 7:
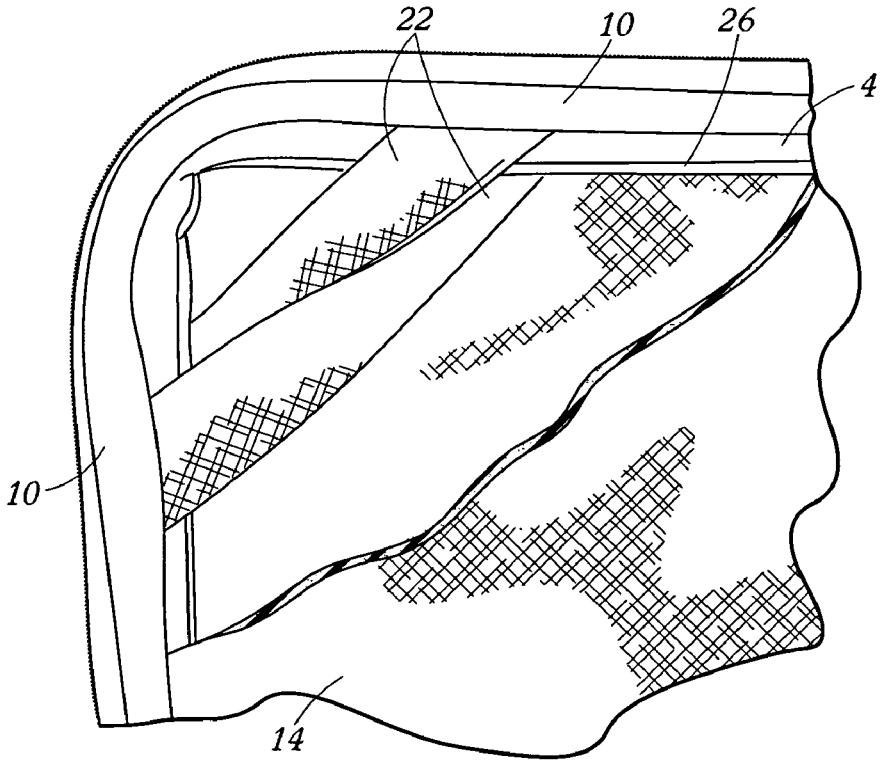
FIG. 7 shows details of each corner of the expansion mechanism.

The gussets themselves 4 are made in the conventional manner using strips of body textile material with edge binding 12 holding the outer edges of one or more of the accordion-like expansion sections 4, as shown in FIG. 6.

Figure 3:
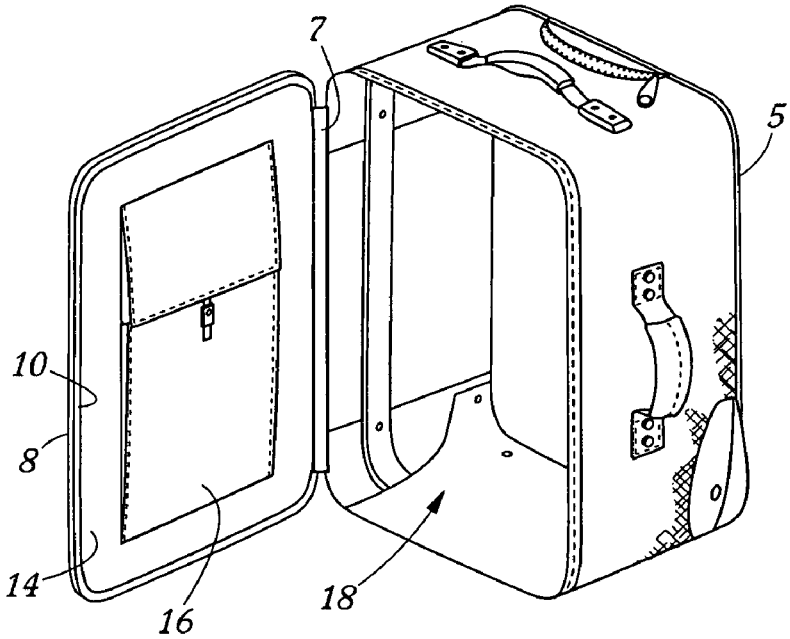
FIG. 3 shows the case with the main packing compartment door open and the expansion gusset carried in the door construction itself.

Panel door 6 includes an inner surface 14 that is preferably made with a layer of elastic textile material such as Spandex or a knit-faced rubber foam material sometimes used for scuba diving wetsuits or the like. As can be seen in FIG. 3, this textile material, when assembled on inner surface 14, hides the many structural features of the expansion gusset 4 itself while providing a mounting surface onto which an additional interior packing compartment 16 can be mounted. Even with the addition of interior packing compartment 16, the elastic textile of inner surface 14 permits packed clothing and the like to push outwardly on the gusseted door 6 and expand its gusset 4 when the main packing compartment 18 is zipped closed.

Figure 4:
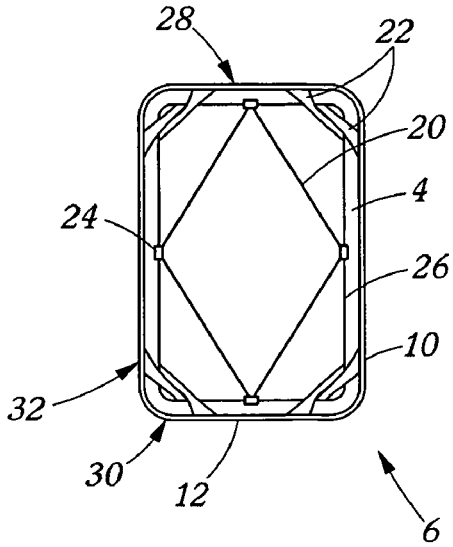
FIG. 4 is a plan view showing the interior of the door and the various elastic members used to control the expansion of the door-carried gusset.

FIG. 4 reveals a bungee cord 20 tensioned and affixed to the central locations on each top 28, bottom 30 and side 32 of the innermost seam 26 of the accordion expansion gusset 4. Bungee cord 20 is threaded through a loop 24 of material, preferably nylon webbing material, that is affixed, preferably by sewing methods, to expansion gusset 4 near the innermost seam 26. At each corner, a pair of crisscrossing elastic ribbons 22 applies tension between the outer steel wire frame 8 and inner steel wire frame 10 in the edge bindings 12 of the main packing door 6. Note that outer steel frame 8 cannot be seen in this view as it is situated directly below inner steel frame 10.

Figure 5:
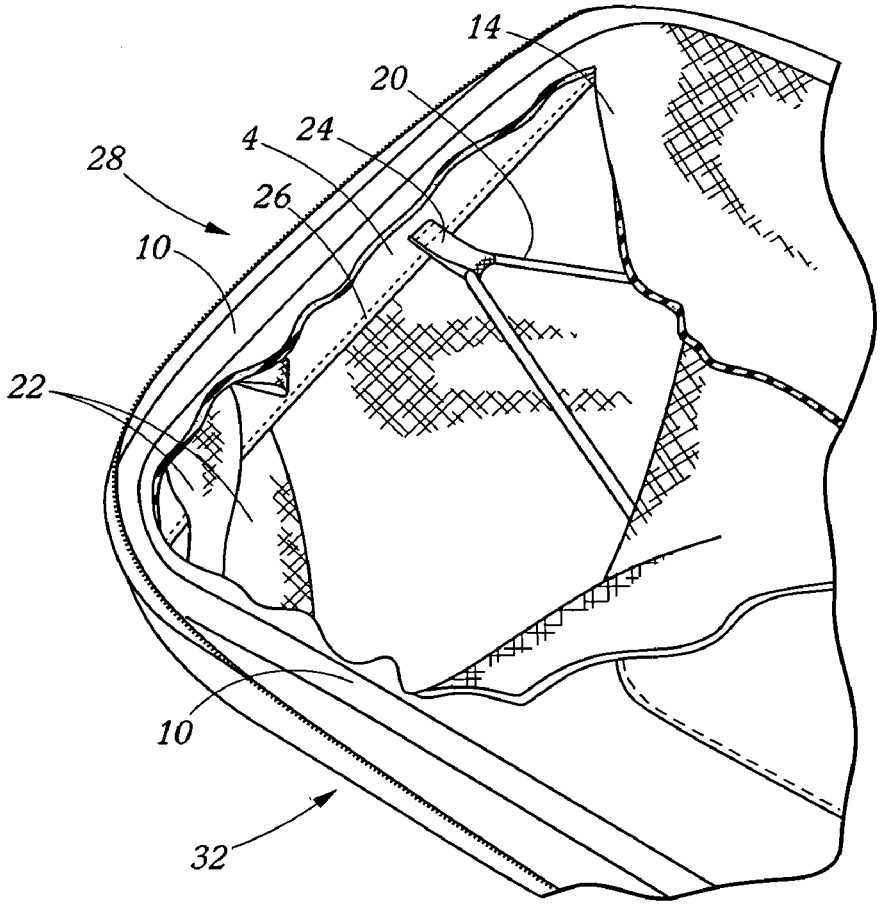
FIG. 5 is a cutaway view showing the detail of one corner of this construction with the gusset in the collapsed position.

FIG. 5 is a cutaway view with a portion of the elastic textile 14 removed to show the details of the elastic ribbons 22 and bungee cord 20 mounting. Note that the elastic ribbons 22 cross one another and the plane containing the inner edge 26 of gusset 4. The elastic ribbons 22 are mounted in a criss-crossing manner in order to utilize mostly horizontal tensions in tangent in order to create a pulling force in a vertical direction. That is, each elastic ribbon 22 applies a restoring force perpendicular to the planes of each of the steel wire frames 8 and 10 to pull the two steel wire frames toward one another. An advantage of this crisscrossing configuration is that storage space within the luggage case 2 is maximized due to the need for only a minimal amount of elastic material. A further advantage of attaching the distal ends of elastic ribbons 22 to frames 10 and 8 as opposed to the inner frame 10 and the seam 26 or other portion of gusset 4 is that better (more) retraction occurs. Referring to FIG. 5, outer steel wire frame 8 is concealed by an expansion panel 4 of collapsed gusset 4. The restoring force created by elastic ribbons 22 is minimal when wire frames 8 and 10 are close together, that is, when the gusset 4 is contracted, and maximum when the wire frames 8 and 10 are further apart. This restoring force is necessary to assure that the outer steel wire frame 8 and inner steel wire frame 10 contract toward one another and present a neat appearance when the case 2 is not over-filled.

Figure 2:
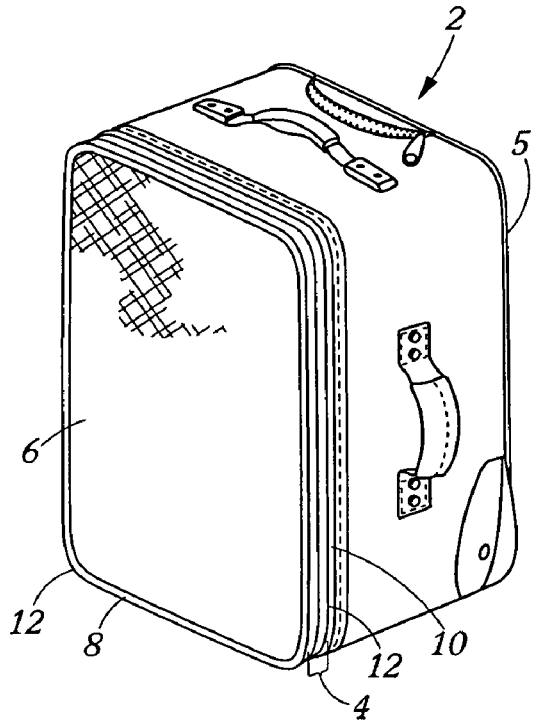
FIG. 2 shows the case with the inventive expansion gusset in the expanded position.

Referring to FIGS. 5 and 6, bungee cord 20 provides an inward tension on the innermost edge 26 of expansion gusset 4. This inward tension assures that the expansion gusset 4 will fold neatly into a compact position between steel wire frames 8 and 10 when the gusset 4 is in its contracted position, as shown in FIG. 5. Bungee cord 20 also provides a further restoring force enhancing the restoring force of the four pairs of crisscrossing elastic ribbons 22. It should be clear that the elastic textile mounted on the inside surface 14 of the case 2 in the plane of outer steel wire frame 8 hides these structures, yet expands outwardly in response to over-packing the case 2. This outward expansion in turn is transferred to the outermost portion of the door 6 which applies a force overcoming the elastic resistance of the crisscrossing elastic ribbons 22 and the tensioned bungee cord 20, resulting in an expanded gusset position 4 as shown in FIG. 2 and in FIG. 6.

Figure 9:
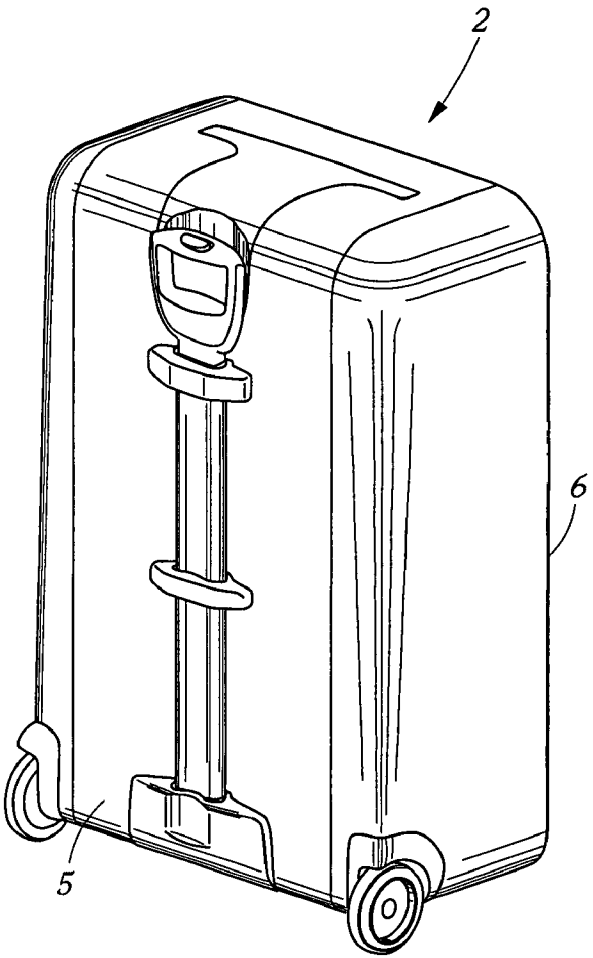
FIG. 9 is a perspective view of that luggage case construction.
Figure 8:
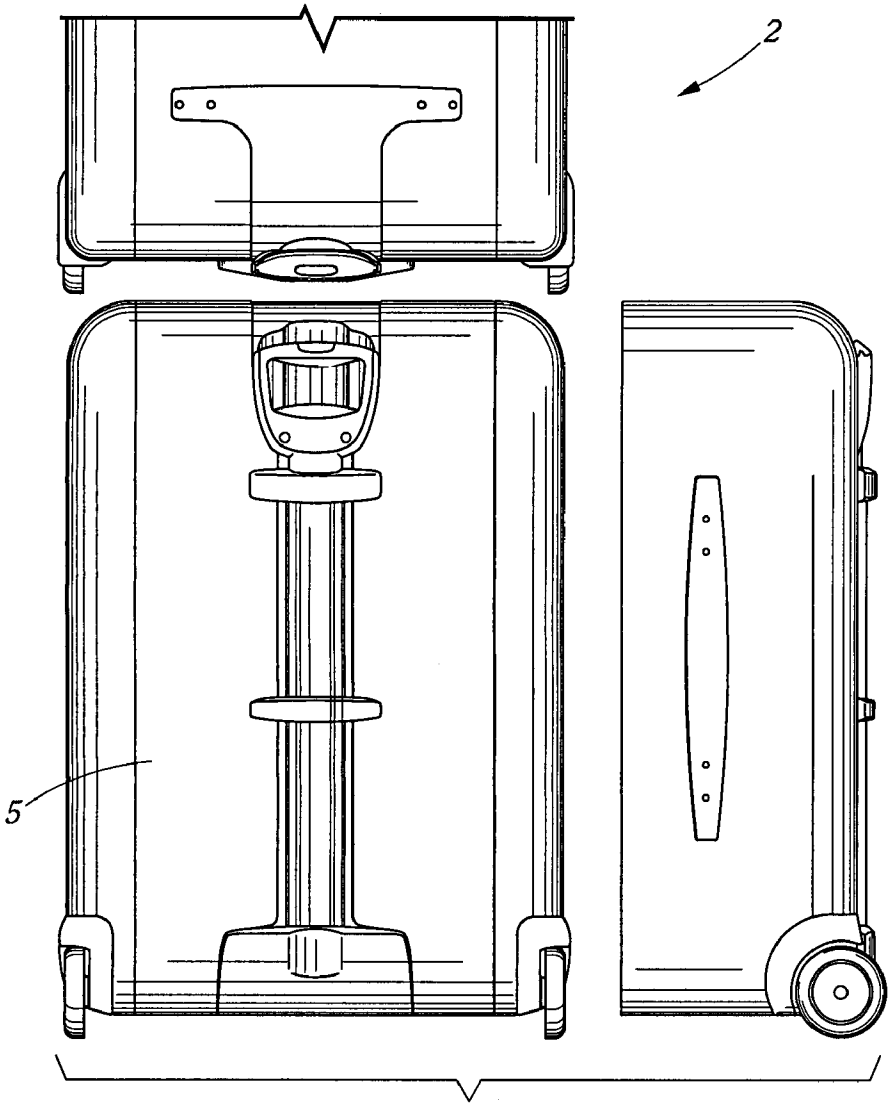
FIG. 8 is an orthographic view of a back, top and side portion of a semi-rigid luggage construction, which can take advantage of the inventive expansion door shown in the previous figures.

FIGS. 8 and 9 show an alternative construction for a base portion 5 of case 2. The alternative embodiment incorporates a rigid base construction 5 with the inventive expansion gusset 4. The door 6, according to the present embodiment, could be attached to this style of luggage case 2 by the same textile self-hinge 7 as shown in FIG. 3, and provide a neat, tailored look consistent with the styling of the rest of the case 2, whether the case 2 is in an over-packed condition or not.

Of course, it should be understood by one of ordinary skill in the art that the present embodiment could be applied to any other form of storage and/or transport vessel and that within this disclosure the term "luggage" is meant to include all types of storage and/or transport vessels including trunks, large storage containers, plastic and other types of shipping boxes for linens and the like, briefcases, computer bags, messenger bags, backpacks, etc.

Although the present embodiment has been described with a certain degree of particularity, it is understood that the present disclosure has been made by way of example, and changes in detail or structure may be made without departing from the spirit of the present embodiment as defined in the appended claims.

We claim:

1. An automatic, zipperless, as-needed expansion system for a luggage case and the like comprising: a container; at least one expandable section, said expandable section comprising at least one expansion panel; a pair of outer edges of said expandable section, said outer edges existing parallel to one another with said expandable section affixed therebetween; and means for applying a force to said pair of outer edges of said expandable section wherein said force vertically biases the outer edges towards one another wherein said biasing force is created by elastomers, said elastomers comprise strips of elastics that are attached at one distal end to one said outer edge of said expandable section and at another distal end to an opposite outer edge of said expandable section, said elastics crisscross secondary elastics that are attached at one distal end to one said outer edge of said expandable section and at another distal end to said opposite outer edge of said expandable section to utilize primarily horizontal tensions to create a vertical pulling force.

2. The elastics of claim 1 wherein said elastics are affixed near corner portions of said container.

3. The system of claim 1 wherein said expansion system further comprises a means for applying a lateral biasing force that contracts each expansion panel of said expandable section inwardly towards one another when expansion of said container is not needed, said lateral biasing force contributing to the vertical biasing force.

4. The system of claim 3 wherein said lateral biasing is created by a bungee cord.

5. The system of claim 4 wherein said bungee cord is connected to a center portion inside of said expansion panel.

6. The system of claim 1 wherein said pair of outer edges of said expandable section comprise a pair of steel wire frames.

7. The system of claim 1 wherein said expansion system comprises a container of soft construction.

8. The system of claim 1 wherein said expansion system comprises a container of rigid construction.

9. The system of claim 1 wherein said expansion system comprises a container of semi-rigid construction.

10. The system of claim 1 wherein said expansion system is enclosed within an inner surface of a door portion of said container and is hidden from view.

* * * * *